US006976305B2

(12) United States Patent
Kanjee et al.

(10) Patent No.: US 6,976,305 B2
(45) Date of Patent: Dec. 20, 2005

(54) ADJUSTABLE TABLE LEG FOR TRUSS FABRICATION SYSTEM

(75) Inventors: Manish C. Kanjee, O'Fallon, MO (US); Kathy LiuHui Jin, Earth City, MO (US)

(73) Assignee: MiTek Holdings, Inc., Wilmington, DE (US)

( * ) Notice: Subject to any disclaimer, the term of this patent is extended or adjusted under 35 U.S.C. 154(b) by 168 days.

(21) Appl. No.: 10/680,854

(22) Filed: Oct. 7, 2003

(65) Prior Publication Data

US 2005/0071994 A1 Apr. 7, 2005

(51) Int. Cl.[7] ..... B30B 3/02

(52) U.S. Cl. ..... 29/772; 29/281.3; 29/897.31; 100/210; 100/913; 269/910; 248/188.8

(58) Field of Search ..... 29/432, 798, 281.3, 29/772, 897.31; 100/913, 210; 269/910; 248/677, 188.8

(56) References Cited

U.S. PATENT DOCUMENTS

| | | | |
|---|---|---|---|
| 3,212,694 | A | 10/1965 | Sanford |
| 3,255,943 | A | 6/1966 | Sanford |
| 3,413,703 | A | 12/1968 | Sanford |
| 3,419,205 | A | 12/1968 | Jureit et al. |
| 3,538,843 | A | 11/1970 | Lubin |
| 3,540,107 | A | 11/1970 | Jureit et al. |
| 3,605,608 | A | 9/1971 | Dagley |
| 3,628,714 | A | 12/1971 | Offenwanger |
| 3,667,379 | A | 6/1972 | Templin |
| 3,711,007 | A | 1/1973 | Fry |
| 3,785,277 | A | 1/1974 | Schmitt |
| 3,855,917 | A | 12/1974 | Farrell et al. |
| 3,925,870 | A | 12/1975 | Adams |
| 3,939,764 | A | 2/1976 | McCormack |
| 4,024,809 | A | 5/1977 | Moehlenpah |
| 4,084,498 | A | 4/1978 | Weaver |
| 4,295,269 | A | 10/1981 | Wright |
| 4,351,465 | A | 9/1982 | Moehlenpah et al. |
| 4,373,652 | A | 2/1983 | Matlock et al. |
| 4,384,515 | A | 5/1983 | Matlock |
| 4,437,234 | A | 3/1984 | Thornton |
| 4,485,606 | A | 12/1984 | Gottlieb |
| 4,570,913 | A | 2/1986 | Rosser |
| 4,669,184 | A | 6/1987 | Castillo |
| 4,955,742 | A | 9/1990 | Marks |
| 5,092,028 | A | 3/1992 | Harnden |
| 5,111,861 | A | 5/1992 | Gore et al. |
| 5,211,108 | A | 5/1993 | Gore et al. |

(Continued)

OTHER PUBLICATIONS

MiTek® Mark V™ Gantry System, 4 pgs., 1993.
MiTek® Roller Gantry Roller Press System, 4 pgs., 1994.
MiTek® Finish Roller, 2 pgs., 1994.
MiTek® RailRider™ Trackless Floor Truss Roller System, 4 pgs., 1997.
MiTek® RoofGlider® Trackless Roof Truss Roller System, 4 pgs. 1998.

*Primary Examiner*—David P. Bryant
*Assistant Examiner*—Jermie E. Cozart
(74) *Attorney, Agent, or Firm*—Senniger Powers

(57) ABSTRACT

An adjustable leg for a truss fabrication system used in mass production of trusses. The system has a truss set-up table and a gantry press movable relative to the truss set-up table for pressing nailing plates into truss members. The table is supported on legs which are readily adjustable in height even after installation of the table to maintain the table in a level orientation.

23 Claims, 5 Drawing Sheets

U.S. PATENT DOCUMENTS

| | | | | |
|---|---|---|---|---|
| 5,553,375 | A | 9/1996 | Powers | |
| 5,768,769 | A | 6/1998 | Shamblin | |
| 6,079,325 | A | 6/2000 | LePoire et al. | |
| RE37,797 | E | 7/2002 | Haase | |
| 6,560,858 | B1 * | 5/2003 | McAdoo | 29/772 |
| 6,807,903 | B2 * | 10/2004 | Anderson | 100/210 |
| 2002/0014573 | A1 * | 2/2002 | Anderson | 248/677 |
| 2003/0196326 | A1 * | 10/2003 | McAdoo | 29/897.31 |

* cited by examiner

ADJUSTABLE TABLE LEG FOR TRUSS FABRICATION SYSTEM

BACKGROUND OF THE INVENTION

This invention relates generally to a truss fabrication system for fabricating trusses, and in particular to a truss fabrication system having readily adjustable legs.

Pre-manufactured structural frameworks, such as trusses, are widely used in the construction industry for forming a roof, wall panel, floor, or other building component because of their strength, reliability, low cost, and ease of use. The trusses are typically assembled in a factory using machinery for mass-fabrication of individual truss components. The trusses are assembled, for example, on large assembly tables and then shipped to construction sites. Each truss includes a collection of typically wooden truss members held together by connectors, such as nailing plates. In assembling trusses, the truss members are arranged on truss assembly setup tables, and nailing plates having nail-like projections or teeth extending from one side are placed at the intersections of the truss members with their teeth pointed toward the surface of the truss members. To facilitate efficient assembly of the truss, a roller or gantry press is used to press the nailing plates into the truss members. The gantry press travels along the table to press the nailing plates into the truss members thereby joining them together. The roller apparatus includes a cylindric roller, roller supports, and several wheels mounted on wheel guides along opposite sides of the table. After traversing the length of the table, the roller apparatus continues moving along the guides and is stopped in a parking area at an end of the table such that the assembled truss can be freely removed from the table without obstruction by the roller apparatus.

The installation of the table gantry press tracks is critical in the proper operation of the gantry press. The truss set-up table work-surface must be level and true with respect to the gantry press to uniformly press the nailing plates into the truss members along the entire length and width of the truss. Gantry press devices of the prior art unfortunately have a number of potential difficulties. For example, initial installation of the table to a perfectly level orientation can be time consuming. Additionally, uneven settling of the ground under the truss set-up table may cause the work surface to become misaligned with the gantry press. Normally, the truss set-up table is fixedly attached to the floor, usually by welding, to prevent movement or wobble of the truss set-up table. It has often been necessary to break the welds to correct any misalignment of the table.

SUMMARY OF THE INVENTION

Among the several objects and features of the present invention may be noted the provision of a truss fabrication system having a truss set-up table which may be readily adjusted in height and adjusted to a level orientation; the provision of such a system which may be readily adjusted after the truss set-up table has been installed without disturbing the fixed attachment of the table to the floor; and the provision of such a system which reduces instability or wobble of the truss set-up table.

In general, a truss fabrication system of the invention is for fabricating trusses, each truss having at least two truss members and at least one connector for connecting the truss members. The system includes a table top defining a worksurface on which the truss members and connectors may be positioned and a gantry press which is movable relative to the table top and configured to press the at least one connector into the truss members to join the truss members. The system also includes a plurality of legs for supporting the table top at a position spaced above an underlying floor and adjustable in height such that the legs may be selectively manipulated to place the table top at a level orientation while the legs are fixedly attached to the floor. Each leg includes a leg member having a threaded opening at one end thereof and a rod having a threaded first end and a second end. The first end is received through the threaded opening such that the rod is selectively rotatable within the threaded opening to adjust a height of the leg so as to adjust the height of the table top above the floor. Each leg also includes a collar with at least one opening therein, the collar being fixedly attached to the floor. The second end of the rod is received through the opening in the collar and is rotatably movable with respect to the collar. The rod is formed to receive a tool for selectively rotating the rod to adjust the length of the leg.

In another aspect, the invention is a truss set-up table for fabricating trusses, each truss having at least two truss members and at least one connector for connecting the truss members. The set-up table includes a table top defining a worksurface on which the truss members and connectors may be positioned. The system also includes a plurality of legs for supporting the table top at a position spaced above an underlying floor and adjustable in height such that the legs may be selectively manipulated to place the table top at a level orientation while the legs are fixedly attached to the floor. Each leg includes a leg member having a threaded opening at one end thereof and a rod having a threaded first end and a second end. The first end is received through the threaded opening such that the rod is selectively rotatable within the threaded opening to adjust a height of the leg so as to adjust the height of the table top above the floor. Each leg also includes a collar with at least one opening therein, the collar being fixedly attached to the floor. The second end of the rod is received through the opening in the collar and is rotatably movable with respect to the collar. The rod is formed to receive a tool for selectively rotating the rod to adjust the length of the leg.

Other objects and features of the present invention will be in part apparent and in part pointed out hereinafter.

BRIEF DESCRIPTION OF THE DRAWINGS

Corresponding reference characters indicate corresponding parts throughout the views of the drawings.

DETAILED DESCRIPTION OF THE PREFERRED EMBODIMENT

Figure 1:
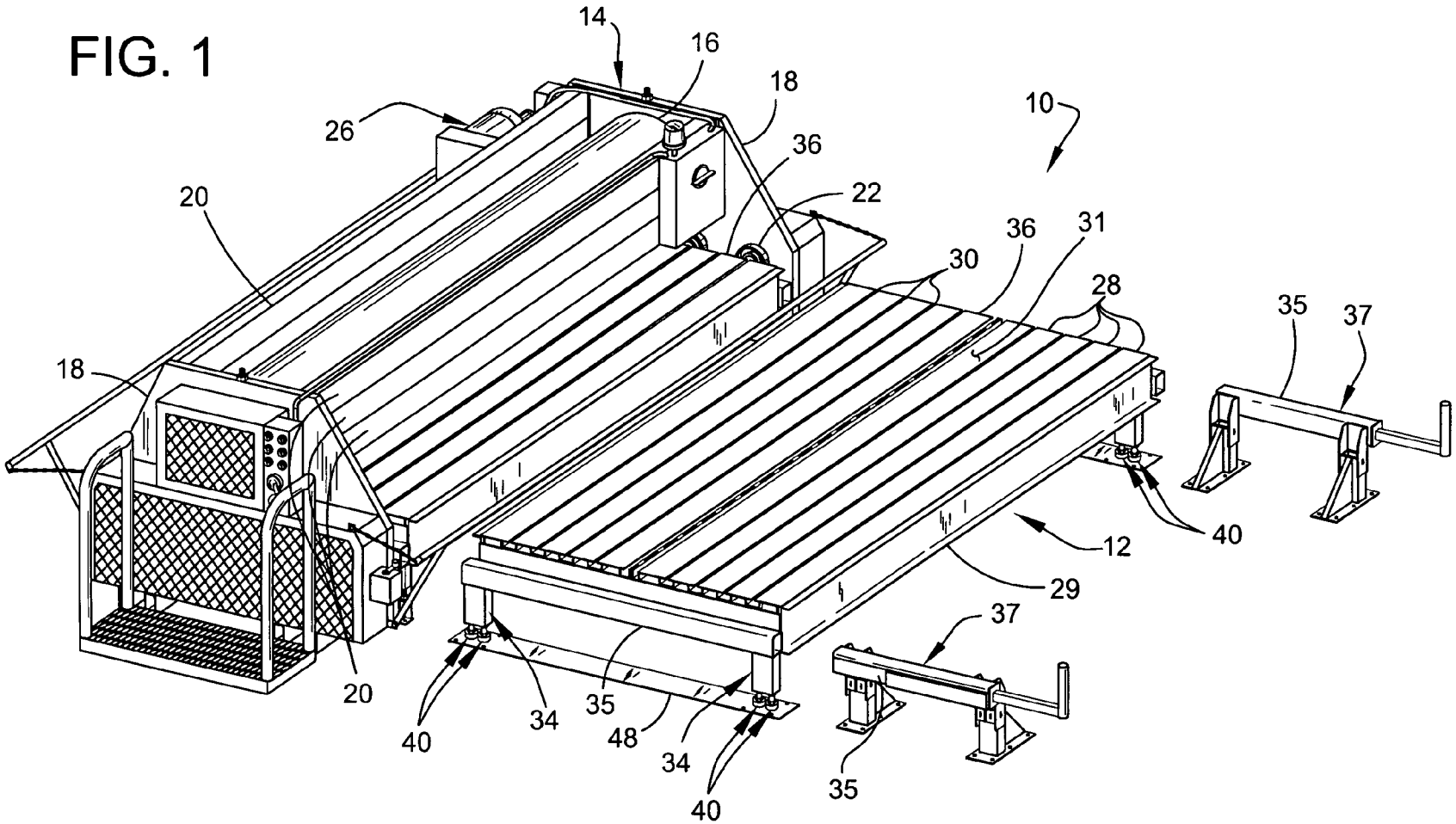
FIG. 1 is a perspective of a truss fabrication system of the present invention.

Referring now to the drawings and in particular to FIG. 1, a truss fabrication system according to the present invention is indicated generally at 10. The system 10 includes a truss set-up table 12 on which truss members and connectors (not shown) may be positioned at a desired configuration for assembly to form a truss. A gantry press, indicated generally at 14, is movable relative to the truss set-up table 12 and has a cylindric roller 16 configured to press one or more connectors into the truss members to interconnect the truss members. The roller 16 extends between and is rotatably mounted on two spaced apart supports 18. Each support is a generally vertically oriented plate, as further described hereinafter, and is interconnected with the opposite support by horizontal spacers 20 extending between the supports. Each support 18 is mounted on four drive wheels 22 (only some of which are shown) aligned in an upper row along the support and four reaction pressure wheels (not shown) aligned in a lower row along the support. The roller 16 and drive wheels 22 are connected in a conventional manner by one or more drive chains (not shown) to a motor system indicated generally at 26. The gantry press 14 can have other configurations, such as different supports or number of wheels, without departing from the scope of this invention. One example of a gantry press of this type is shown in co-assigned U.S. Pat. No. 6,079,325, the disclosure of which is incorporated herein by reference. Those of ordinary skill in the art will readily appreciate the construction and operation of gantry presses. Accordingly, additional details of construction and operation of the gantry press will not be described herein.

The truss set-up table 12 has a plurality of parallel, elongate panels 28 providing a worksurface for placement of truss members. Slots 30 are left between adjacent pairs of panels 28 suitable for placement of conventional positioning stops (not shown) capable of being fixed along the slot to collectively form a jig for locating and holding truss members on the worksurface. The elongate panels 28 are mounted on a frame 29. The panels 28 and frame 29 form a table top supported by a plurality of legs, indicated generally at 34. The legs are adjustable in length and are fixedly attached to an underlying surface as described in more detail below. Except as further described, the set-up table 12 may be of conventional construction.

The truss set-up table 12 includes two spaced sections 36 of the table which are aligned in a row. The table may be a single section, or may include more than two sections without departing from the scope of the present invention. During operation, truss members may rest solely on one section 36, or if larger may extend across several sections. A space between adjacent sections 36 is sized for a person to walk in between the sections to set up the truss members and connectors, with a typical spacing being 15 inches. In the preferred embodiment, each section 36 has four legs. Other numbers and types of legs do not depart from the scope of this invention.

Two wheel guides 35 are securely mounted on the frame 29 opposite sides of each truss table section 36. The gantry press 14 is capable of traversing the space between the wheel guides 35 or adjacent sections 36 as it travels from one end of the table 12 to the other as set forth in U.S. Pat. No. 6,079,325. The guides 35 are provided for supporting and directing movement of the gantry press 14 relative to the truss set-up table. Each guide 35 comprises a suitably shaped elongate box beam extending generally along the table 12 and which provides tracks for engagement by drive wheels 22 and pressure wheels of the gantry press 14. For instance, in one embodiment, each guide 35 is formed of a five inch by five inch square steel beam. An upper surface of the guide 35 is generally flat and provides a track for the drive wheels 22. A lower surface of the guide 35 is also generally flat and provides a track for the pressure wheels. It is understood that there could be other types and locations of guides (including on the floor), or only one guide, without departing from the scope of this invention.

A parking area at one end of the table 12 includes a pair of stands (each designated generally at 37) aligned with and spaced from the endmost section 36 of the truss set-up table 12. The stands include guides 35 which receive the drive wheels 22 and reaction pressure wheels for supporting the gantry press 14 away from the table sections 36. After the gantry press 14 has traveled along the length of the truss set-up table 12, it moves onto the stands 37 in the parking area where it may be stopped and where it does not overlie the assembled truss so as to not interfere with removal of the truss or placement of truss members and connectors for a new truss. An additional parking area (not shown) may be provided on an opposite end of the truss set-up table.

When the motor system 26 is activated, the drive wheels 22 move the gantry press 14 until the roller 16 rolls onto the surfaces of the truss members and connectors, raising the gantry press. At that point, the drive wheels 22 become substantially unloaded, with the weight of the gantry press 14 bearing on the roller 16. The reaction pressure wheels augment a pressing force imparted by the roller 16 to the connectors (i.e., beyond the weight of the gantry press), by strongly opposing substantial upward movement of the roller 16 when rolling over truss members. The connectors are pressed into the truss members as the roller passes over them.

Figure 2:
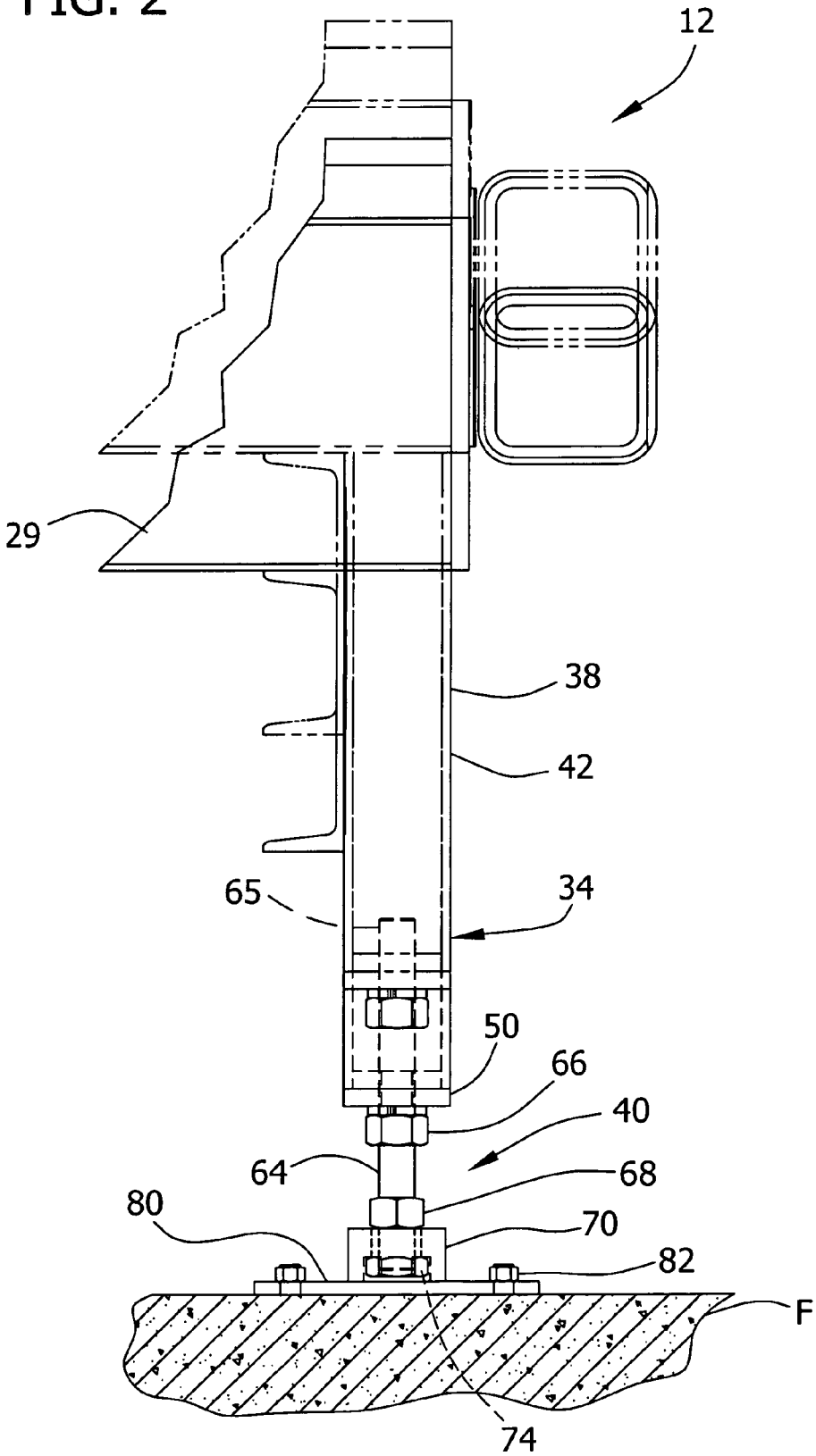
FIG. 2 is an enlarged fragment of a table of the truss fabrication system showing a table leg and illustrating height adjustability of the leg.

Referring now to FIG. 2, the legs 34 support the elongate panels 28 and frame 29 at positions spaced above an underlying floor F. The table top must be placed at a level orientation to enable proper operation of the gantry press 14. The legs 34 are adjustable in length and may be selectively and individually manipulated during initial installation and as needed to level the table 12. Each leg 34 includes a leg member 38 and at least one adjustable foot, indicated generally at 40, extending from the leg member. The leg member 38 is attached in a suitable manner (such as by welding) to the frame 29 of the table 12. The leg member 38 and foot 40 are configured to be adjustable so that the height of the table 12 at the location of a given leg can be adjusted as necessary (e.g., between the two positions shown in solid and phantom in FIG. 2) even after the leg 34 is fixedly attached to the floor F to maintain the table in a level orientation and compensate for any settling or other factors that may affect the orientation of the table. As shown in the embodiment depicted in FIG. 1, each of the leg members 38 has two substantially identical feet 40 contacting the floor F. Having two feet 40 inhibits instability or wobble of the table by providing a larger combined surface area for engaging the floor F. It will be understood that one or more of the legs 34 of the table 12 could be of fixed length without departing from the scope of the present invention, so long as one leg is adjustable.

Figure 3A:
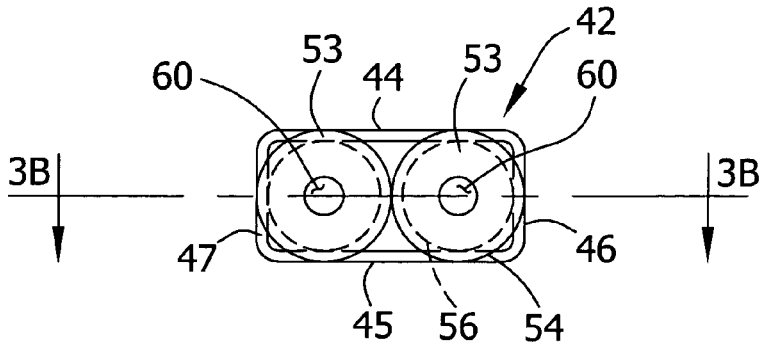
FIG. 3A is a bottom plan view of a leg member of the table leg of FIG. 2.
Figure 3B:
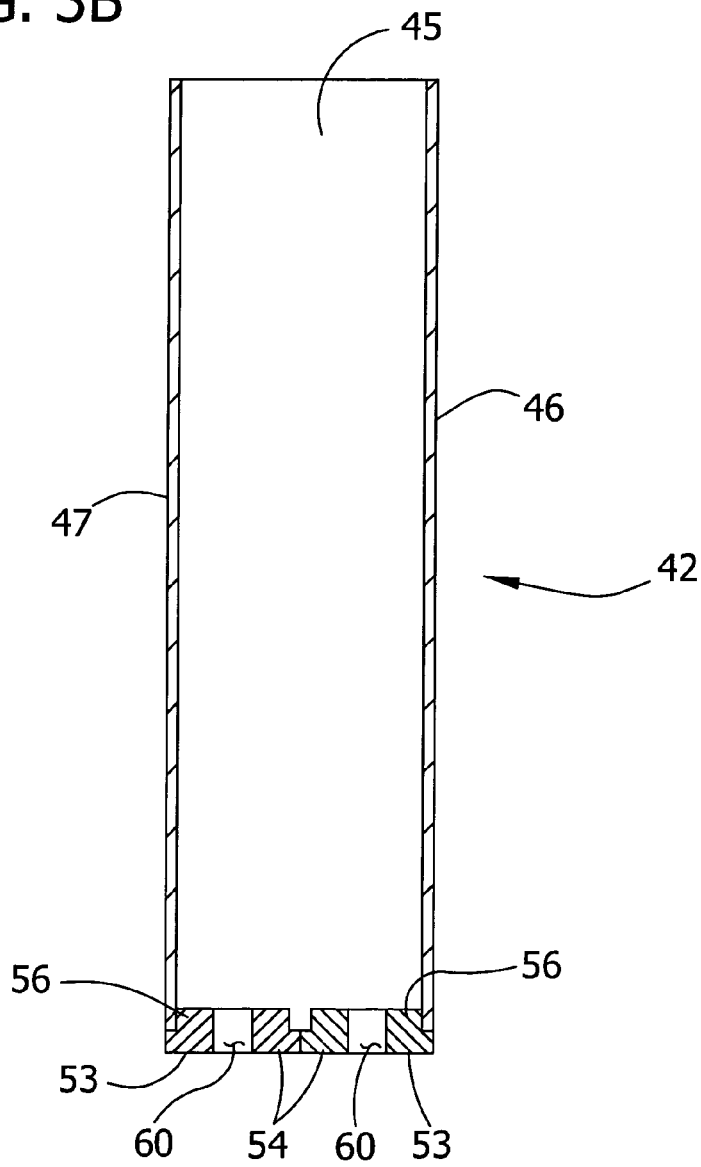
FIG. 3B is a section taken on line 3B—3B of FIG. 3A.
Figure 4A:
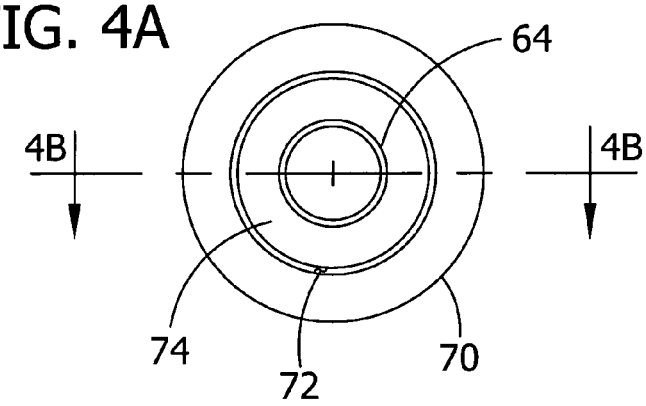
FIG. 4A is a top plan view of a foot of the table leg of FIG. 2.
Figure 4B:
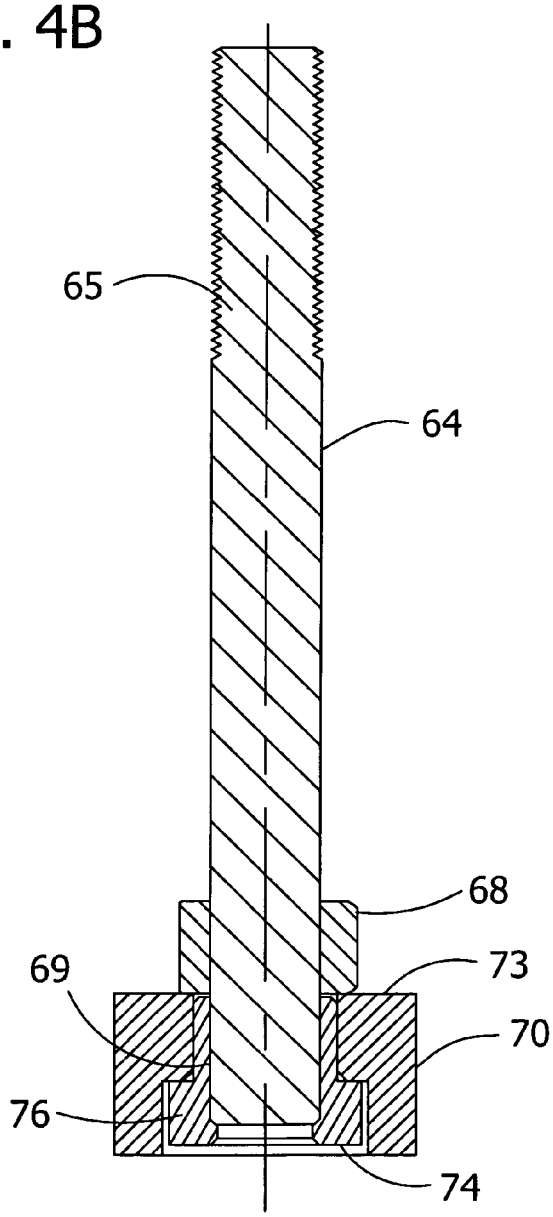
FIG. 4B is a section taken on line 4B—4B of FIG. 4A.
Figure 5A:
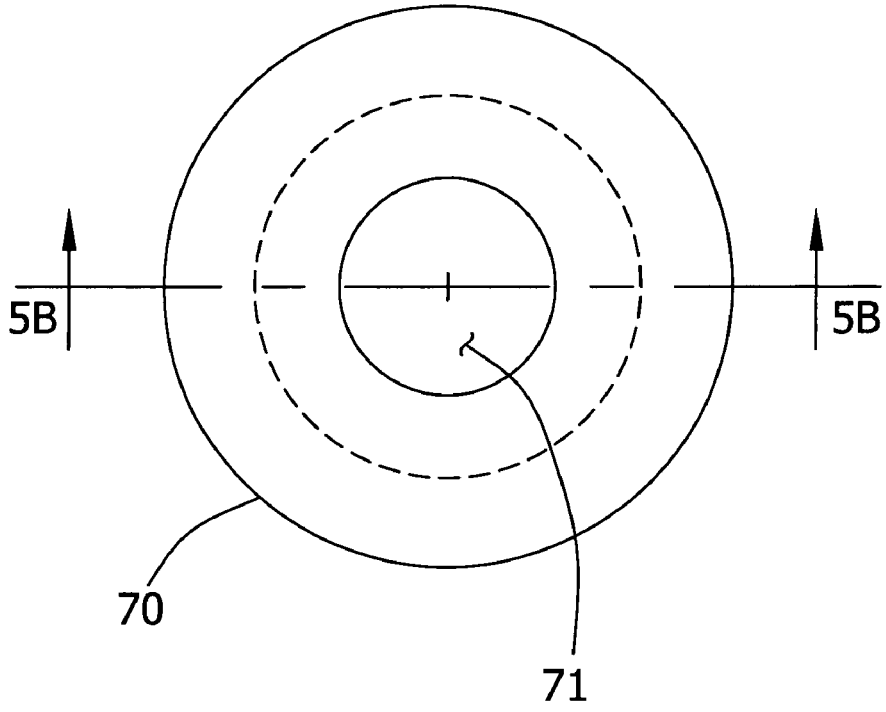
FIG. 5A is a top plan view of a collar of the foot of FIG. 4A.
Figure 5B:
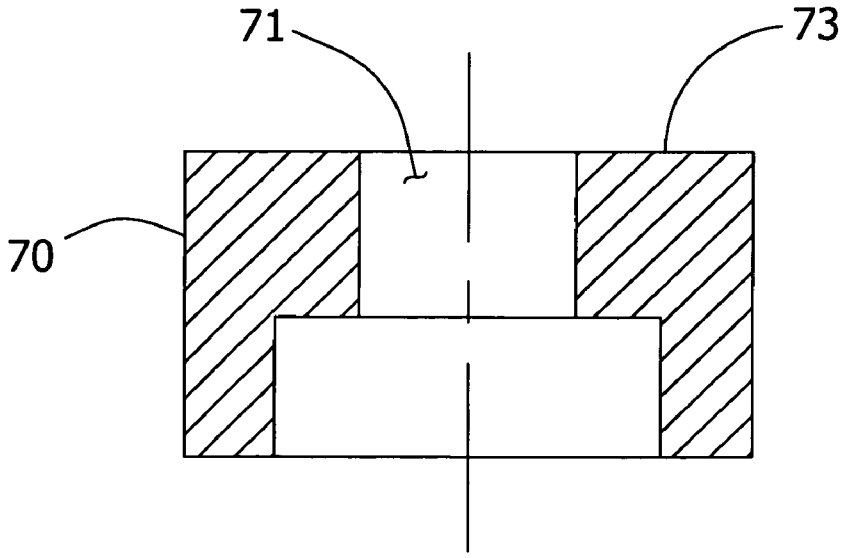
FIG. 5B is a section taken on line 5B—5B of FIG. 5A.

Referring now to FIGS. 3A and 3B, the leg member 38 comprises a rectangular steel tube 42 having a wall thickness of about 0.25 inches. For instance, the leg member 38 is suitably a 6 inch by 3 inch tube 42 having side walls 44, 45, a front wall 46 and a back wall 47, although other sizes and shapes such as square and round are contemplated without departing from the scope of the invention. Two substantially identical end caps 53 or pucks are attached side-by-side as by welding to the lower end of leg member 38. The end cap 53 has a larger cylindrical portion 54 sized to engage the edges of the leg member 38 and a smaller upper cylindrical portion 56 sized to be received into the open lower end of the leg member. The upper portion 54 and lower portion 56 are formed as one piece; alternately, the smaller portion is attached to the larger portion such as by welding. Each end cap 53 has a threaded opening 60 for receiving a respective foot 40. The threaded openings 60 may be provided by structure other than the end caps 53 such as a plate with holes drilled therein or a single endcap without departing from the scope of the present invention.

Referring to FIGS. 2 and 4A–5B, each foot 40 includes a rod 64 with a threaded upper portion 65. The threaded upper portion 65 is received by the opening 60 (FIG. 3A) of the leg member 38 so that the rod extends from the leg member and is threadably engaged with the leg member 38 as shown in FIG. 2. Because of the threaded engagement of the rod 64 with the leg member 38, rotation of the rod in one direction extends the rod from the leg member for lengthening the leg 34. Rotation of the rod 64 in the opposite direction retracts more of the rod into the leg member 38, shortening the leg 34. In one embodiment, the rod has a diameter of about 1.00 inch (2.54 cm) and is about 10 inches (25 cm) in length, although other diameters and lengths are contemplated without departing from the scope of the invention. A jam nut 66 is positioned on the rod 64 below the disk 53. The jam nut 66 is threadedly engaged with the upper portion 65 of the rod 64 and is used to secure the position of the leg member 38 and rod 64 as will be described below.

An adjusting nut 68 is positioned on the rod 64 and affixed to the rod such as by welding so that the adjusting nut can be used to rotate the rod. Alternately, the rod 64 may be manufactured such that the adjusting nut 68 is formed as one piece with the rod without departing from the scope of the invention. Other structures (not shown) for engaging the rod 64 with a tool to effect rotation may be used within the scope of the present invention.

A lower portion 69 of the rod 64 is received through a counterbored opening 71 (FIGS. 5A and 5B) in a collar 70. In one embodiment, the collar 70 is a cylindrical steel member having a top surface 73. The opening 71 has a diameter larger than the rod 64 so that the rod is capable of rotation with respect to the collar 70. The opening 71 is free of threads so that the rod 64 may rotate freely in the opening without incurring axial movement of the rod 64 with respect to the collar 70. A flanged cap 74 is fixed to the rod 64 below the top surface 73 as by welding. The cap 74 is disposed inside the collar 70 in the opening so that a wider flange 76 of the cap is received in the counterbored portion of the opening. The flange 76 opposes a portion of the collar 70 in the opening 71. Thus, the rod 64 cannot pass out of the opening 71 through the top surface 73 of the collar 70. The rod 64 may be formed such that the cap 74 is formed as one piece with the rod without departing from the scope of the invention. Additionally, the rod 64 may have a jam nut (not shown) above the collar 70 and an adjusting nut welded to the above the jam nut at a location that permits enough room to adjust the height of the table.

The collar 70 is fixed to an anchor plate 80 (FIG. 2) as by welding. Alternately, the collar 70 may have a flange (not shown) extending therefrom having holes for receiving fasteners to attach the collar to the anchor plate 80. The anchor plate is fixedly attached to the floor F, such as by threaded fasteners 82 which extend into the floor. The anchor plate 80 is desirably steel, such as hot rolled steel, which is configured into a substantially perfectly level orientation on the floor F. It is understood that other configurations for fixedly attaching the collar 70 to the floor, such as direct engagement of the collar with the floor F without an anchor plate 80, do not depart from the scope of this invention. The collar 70 prevents translational movement of the leg 34 with respect to the floor in a lateral, longitudinal or a vertical direction of the leg during operation of the truss fabrication system 10. The weight of the table 12 is thus transferred through the adjusting nut 68 on the rod 64 to the collar 70 and onto the anchor plate 80 and then to the floor F. The cap 74 in the opening 71 is spaced above the anchor plate 80.

During initial installation of each table section 36, the rod 64 of each foot 40 is inserted through the opening 71 in the collar 70 so that the cap 74 is inside the collar 70. A smaller portion of the cap 74 fits into a smaller portion of the opening 71. The adjusting nut 68 is placed on the rod so that it rests on the upper surface 73 of the collar. In one embodiment, the adjusting nut 68 rests adjacent the collar so that any gap between the adjusting nut and collar 70 is removed but the rod 64 is still able to rotate with respect to the collar. The upper portion 65 of the rod 64 is inserted into the opening 60 to threadably engage the rod with the leg member 38. The adjusting nut 68 is suitably fixed to the rod 64, such as by welding, and the collar is fixedly attached to the floor F, such as by welding the collar to the anchor plate 80, to securely fix the foot 40 to the floor. This procedure is repeated for the other foot 40 of the leg 34, and for the feet of the other legs.

To adjust the height of the table 12, or to change the height of one or more of the legs 34 to place the table top 31 in a substantially level condition, the jam nut or nuts 66 on the leg to be adjusted are first loosened to provide a gap between the jam nut and the lower end of the leg member 38. Adjustment of the foot 40 is accomplished by rotation of the rod 64 using a wrench (not shown) received on the adjustment nut 68. As the rod 64 rotates, the leg member 38, which is threadably engaged with the rod, moves in an axial direction relative to the rod and the collar 70 on the threaded upper portion 65. The rod 64 remains in substantially the same axial position relative to the collar 70 and the anchor plate 80. For leg members 38 having two feet 40, the adjustment rod 64 for each foot is rotated either simultaneously or sequentially to adjust the height of the leg member 38. After the leg member 38 has been adjusted to the desired height, the jam nut 66 is re-tightened to secure the leg 34 at the selected height. This adjustment can be done any number of times without affecting the securement of the table to the floor.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above without departing from the scope of the invention, it is intended that all matter contained in the above description and shown in the accompanying drawings shall be interpreted as illustrative and not in a limiting sense.

What is claimed is:

1. A truss fabrication system for fabricating trusses, each truss having at least two truss members and at least one connector for connecting the truss members, the system comprising:

a table top defining a worksurface on which said truss members and connectors may be positioned;

a gantry press which is movable relative to the table top and configured to press said at least one connector into the truss members to join the truss members; and a plurality of legs for supporting the table top at a position spaced above an underlying floor and adjustable in height such that the legs may be selectively manipulated to place the table top at a level orientation while the legs are fixedly attached to the floor, each leg comprising:

a leg member having a threaded opening at one end thereof;

a rod having a threaded first end and a second end, said first end being received through said threaded opening such that the rod is selectively rotatable within said threaded opening to adjust a height of the leg so as to adjust the height of the table top above the floor;

a collar with at least one opening therein, the collar being fixedly attached to the floor by an anchor plate, wherein the second end of the rod is received through the opening in the collar and is rotatably movable with respect to the collar; and the anchor plate fixedly attached to the floor;

wherein said collar is welded to the anchor plate and thereby fixedly attached to the anchor plate;

and wherein the rod is formed to receive a tool for selectively rotating the rod to adjust the length of the leg.

2. A truss fabrication system as set forth in claim 1 wherein the height of said leg can be adjusted after said collar is affixed to the floor.

3. A truss fabrication system as set forth in claim 1 wherein the rod includes an adjusting nut fixed to the rod for use in rotating the rod.

4. A truss fabrication system as set forth in claim 3 wherein the adjusting nut is welded to the rod.

5. A truss fabrication system as set forth in claim 3 wherein said adjusting nut is positioned on the rod between said leg member and said collar.

6. A truss fabrication system as set forth in claim 3 wherein said adjusting nut transfers the weight of the table onto the collar.

7. A truss fabrication system as set forth in claim 1 wherein said leg member comprises an end cap positioned at the end of the leg member, wherein said threaded opening is located in said end cap.

8. A truss fabrication system as set forth in claim 1 wherein said leg member is a rectangular steel tube.

9. A truss fabrication system as set forth in claim 1 wherein said rod is a first rod and said collar is a first collar, each leg further comprising a second rod and a second collar substantially similar to said first rod and first collar, said second rod received through a second threaded opening such that the second rod is selectively rotatable within said second threaded opening to adjust a height of the leg so as to adjust the height of the table top above the floor and the second collar being fixedly attached to the floor and receiving said second rod.

10. A truss set-up table for fabricating trusses, each truss having at least two truss members and at least one connector for connecting the truss members, the truss set-up table being for use with a gantry press which is movable relative to the table and configured to press said at least one connector into the truss members to join the truss members, the set-up table comprising:

a table top defining a worksurface on which said truss members and connectors may be positioned; and a plurality of legs for supporting the table top at a position spaced above an underlying floor and adjustable in height such that the legs may be selectively manipulated to place the table top at a level orientation while the legs are fixedly attached to the floor, each leg comprising:

a leg member having a threaded opening at one end thereof;

a rod having a threaded first end and a second end, said first end being received through said threaded opening such that the rod is selectively rotatable within said threaded opening to adjust a height of the leg so as to adjust the height of the table top above the floor;

a collar with at least one opening therein, the collar being fixedly attached to the floor by an anchor plate, wherein the second end of the rod is received through the opening in the collar and is rotatably movable with respect to the collar; and the anchor plate fixedly attached to the floor;

wherein said collar is welded to the anchor plate and thereby fixedly attached to the anchor plate;

and wherein the rod is formed to receive a tool for selectively rotating the rod to adjust the length of the leg.

11. The truss set-up table set forth in claim 10 wherein said leg can be adjusted after said collar is affixed to the floor.

12. The truss set-up table set forth in claim 10 wherein the rod includes an adjusting nut fixed to the rod for use in rotating the rod.

13. The truss set-up table set forth in claim 12 wherein the adjusting nut is welded to the rod.

14. The truss set-up table set forth in claim 12 wherein said adjusting nut is positioned on the rod between said leg member and said collar.

15. The truss set-up table set forth in claim 12 wherein said adjusting nut transfers the weight of the table onto the collar.

16. The truss set-up table set forth in claim 10 wherein said leg member comprises an end cap positioned at the end of the leg member, wherein said threaded opening is located in said end cap.

17. The truss set-up table set forth in claim 10 wherein said leg member is a rectangular steel tube.

18. A truss fabrication system as set forth in claim 10 further comprising a flanged cap fixed to the rod and disposed inside the collar.

19. A truss set-up table for fabricating trusses, each truss having at least two truss members and at least one connector for connecting the truss members, the truss set-up table being for use with a gantry press which is movable relative to the table and configured to press said at least one connector into the truss members to join the truss members, the set-up table comprising:

a table top defining a worksurface on which said truss members and connectors may be positioned; and a plurality of legs for supporting the table top at a position spaced above an underlying floor and adjustable in height such that the legs may be selectively manipulated to place the table top at a level orientation while the legs are fixedly attached to the floor, each leg comprising:

a leg member having a threaded opening at one end thereof;

a rod having a threaded first end and a second end, said first end being received through said threaded opening such that the rod is selectively rotatable within said threaded opening to adjust a height of the leg so as to adjust the height of the table top above the floor;

a collar with at least one opening therein, the collar being fixedly attached to the floor, wherein the second end of the rod is received through the opening in the collar and is rotatably movable with respect to the collar;

the rod being formed to receive a tool for selectively rotating the rod to adjust the length of the leg;

wherein said rod is a first rod and said collar is a first collar, each leg further comprising a second rod and a second collar substantially similar to said first rod and first collar, said second rod received through a second threaded opening such that the second rod is selectively rotable within said second threaded opening to adjust a height of the leg so as to adjust the height of the table top above the floor and the second collar being fixedly attached to the floor and receiving said second rod.

20. The truss set-up table set forth in claim 19 wherein each leg can be adjusted after said first and second collars are affixed to the floor.

21. The truss set-up table set forth in claim 19 wherein each of the first and second rods includes an adjusting nut fixed to the rod by welding for use in rotating the rod.

22. The truss set-up table set forth in claim 19 wherein each leg member comprises an end cap positioned at the end of the leg member, wherein each of said threaded openings is located in said end cap.

23. The truss set-up table set forth in claim 19 further comprising a flanged cap fixed to each of the first and second rods and disposed inside the respective collar.

* * * * *